US005138363A

United States Patent [19]

Yuge

[11] Patent Number: 5,138,363

[45] Date of Patent: Aug. 11, 1992

[54] TRANSFER DEVICE FOR DUPLEX COPIER USING A SINGLE CHARGER AND TRANSFER BELT

[75] Inventor: Shizuo Yuge, Toyokawa, Japan

[73] Assignee: Minolta Camera Co., Ltd., Osaka, Japan

[21] Appl. No.: 662,767

[22] Filed: Feb. 28, 1991

[30] Foreign Application Priority Data

Mar. 2, 1990 [JP] Japan ..... 2-052295

[51] Int. Cl.[5] ..... G03G 21/00

[52] U.S. Cl. ..... 355/24; 355/275; 355/326

[58] Field of Search ..... 355/24, 26, 272, 274, 355/275, 319, 326, 328

[56] References Cited

U.S. PATENT DOCUMENTS

| | | | |
|---|---|---|---|
| 3,697,170 | 10/1972 | Bhagat et al. | 355/319 X |
| 3,697,171 | 10/1972 | Sullivan | 430/126 |
| 3,847,478 | 11/1974 | Young | 355/274 |
| 4,448,872 | 5/1984 | Vandervalis | 355/24 X |
| 4,659,211 | 4/1987 | Oka | 355/268 |
| 4,714,939 | 12/1987 | Ahern et al. | 355/24 X |
| 4,959,669 | 9/1990 | Haneda et al. | 355/326 X |

FOREIGN PATENT DOCUMENTS

| | | | |
|---|---|---|---|
| 0209471 | 8/1989 | Japan . | |
| 0209472 | 8/1989 | Japan . | |
| 0037369 | 2/1990 | Japan | 355/319 |

*Primary Examiner*—A. T. Grimley
*Assistant Examiner*—J. E. Barlow, Jr.
*Attorney, Agent, or Firm*—Price, Gess & Ubell

[57] ABSTRACT

A polarity inverting charger is provided at the location between developing position of a photoconductor and transfer position to invert the polarity of a toner image formed on the photoconductor after a first image is transferred onto an intermediate transfer belt from the photoconductor. A transfer charger is actuated with opposite polarity to that of the polarity when the first toner image is transferred onto the intermediate transfer belt to transfer the first toner image on the intermediate transfer belt onto a second surface of a transfer sheet simultaneously when a polarity inverted second image on the photoconductor is transferred onto a first surface of the transfer sheet.

9 Claims, 2 Drawing Sheets 1
2
3
4
5
6a
6b
7
8
9
10
11
11a
15
16
17
18
19
19
20
21
22
22
31
32
33
34

TRANSFER DEVICE FOR DUPLEX COPIER USING A SINGLE CHARGER AND TRANSFER BELT

BACKGROUND OF THE INVENTION

1. Technical Field of the Invention

The present invention relates to an image forming apparatus for use in copying machines, printers and similar image forming apparatus, and more particularly, to an image forming apparatus capable of forming images on both sides of a transfer sheet by collectively transferring a visualized image formed on a photoconductor and another visualized image which had been formed on the photoconductor and transferred on an intermediate transfer medium onto a transfer sheet which passes through the location opposite to the photoconductor and the intermediate transfer medium.

2. Brief Description of Related Art

As a general method of forming images on both sides of a sheet in a conventional copying machine, it has heretofore been known that a first image formed on a photoconductor is transferred and fixed on one side of a transfer sheet and then the sheet on which the first image has been transferred is turned over for forming a second image whereby the second image is transferred and fixed on another side of the transfer sheet. In U.S. Pat. No. 3,697,170, there is disclosed an image forming apparatus which is arranged to collectively transfer images on both sides of a transfer sheet by using a photoconductor and transfer roller or transfer belt. Theoretically, either the transfer roller or the transfer belt may be used with the same effect.

In the case of an apparatus which is provided with the transfer belt, for instance, a first image formed on the photoconductor is transferred onto the transfer belt by a transfer charger and toner polarity of the first image transferred on the transfer belt is inverted by a toner polarity inversion charger. The first image on the transfer belt and the second image formed on the photoconductor are simultaneously transferred by the transfer charger on both sides of the transfer sheet fed to the location between the photoconductor and the transfer belt, and the images are formed on both sides of the sheet after fixing process.

In the method of separately transferring and fixing the first and second images, however, it is necessary to re-supply the transfer sheet on which the first image has been transferred and fixed for transferring and fixing the second image by turning over the transfer sheet. Accordingly, another sheet transport path is required for the re-supply of the transfer sheet thereby causing the size of the apparatus to be large, 30–40% larger in volume, resulting in a considerable rise in production cost.

Another problem is that heat curling can occur during a first round of a fixing process, and it causes another problem of an irregular sheet feed in the transport path in a second round of transfer and fixing operations. Moreover, considerable time is required for forming images on both sides of the sheet since two rounds of paper feed have to be performed.

The apparatus disclosed in U.S. Pat. No. 3,697,170 is capable of solving such problems as described above since images are simultaneously transferred on both sides of a transfer sheet. However, there is a difficulty in making sufficient polarity inversion since toner polarity of a first image on the transfer belt is inverted, and an electric charge to be applied to toner becomes small.

Generally, a film or elastic belt material is used as a material for the transfer belt. If a thin film is used repeatedly, the edge of the film is easily broken, and in the case of an elastic belt, it is easily expanded to invite a problem of insufficient synchronization between the images. In order to cope with such problems, it is necessary to make the belt thick. However, if the belt is made too thick, electrostatic capacity C of toner layer and the transfer belt become small. Therefore, when polarity inversion is made by corona charge, sufficient amount of electric charge Q can not be given exceeding $Q=CV$ (V is voltage). It may be considered to raise the voltage V, however, if the amount of electricity becomes sufficiently large, there occurs leakage through the transfer belt and a toner image is put into disorder. The transfer efficiency is thus lowered since a sufficient amount of electricity can not be given and the polarity of the whole toner can not be inverted. Dispersion of toner or the like easily occurs since the amount of electric charge of toner is small.

The apparatus is, therefore, easily affected by the quality and thickness of transfer sheet at the time of the transfer process thereby causing toner dispersion and a poor transfer of image. Moreover, when an image is formed on one side of a transfer sheet only, a proper image formation can not be achieved since transfer efficiency is different from the case of collective transfer on both sides of the sheet.

SUMMARY OF THE INVENTION

A main object of the present invention is to provide an image forming apparatus which is capable of forming a stabilized and proper image without the need of making the apparatus large in size even though a both sides image forming operation is carried out therein, and also capable of rapidly forming images on both sides of a sheet without having the troubles of poor transport of the sheet and bad affection by the quality and thickness of the transfer sheet.

Another object of the present invention is to provide an image forming apparatus and method of image forming process which are capable of solving problems inherent in the conventional apparatus with a simple improvement wherein the polarity of a second image before transfer process is inverted in order to be able to collectively transfer first and second images which are succesively formed on the photoconductor.

These and other objects and features of the present invention will become more apparent from the following description taken in conjunction with the accompanying drawings which illustrate specific embodiments of the invention.

DESCRIPTION OF THE PREFERRED EMBODIMENT

An embodiment of the present invention which is applied to a copying machine capable of performing double sided copying will now be described below referring to the accompanying drawings FIG. 1 through FIG. 3.

Figure 1:
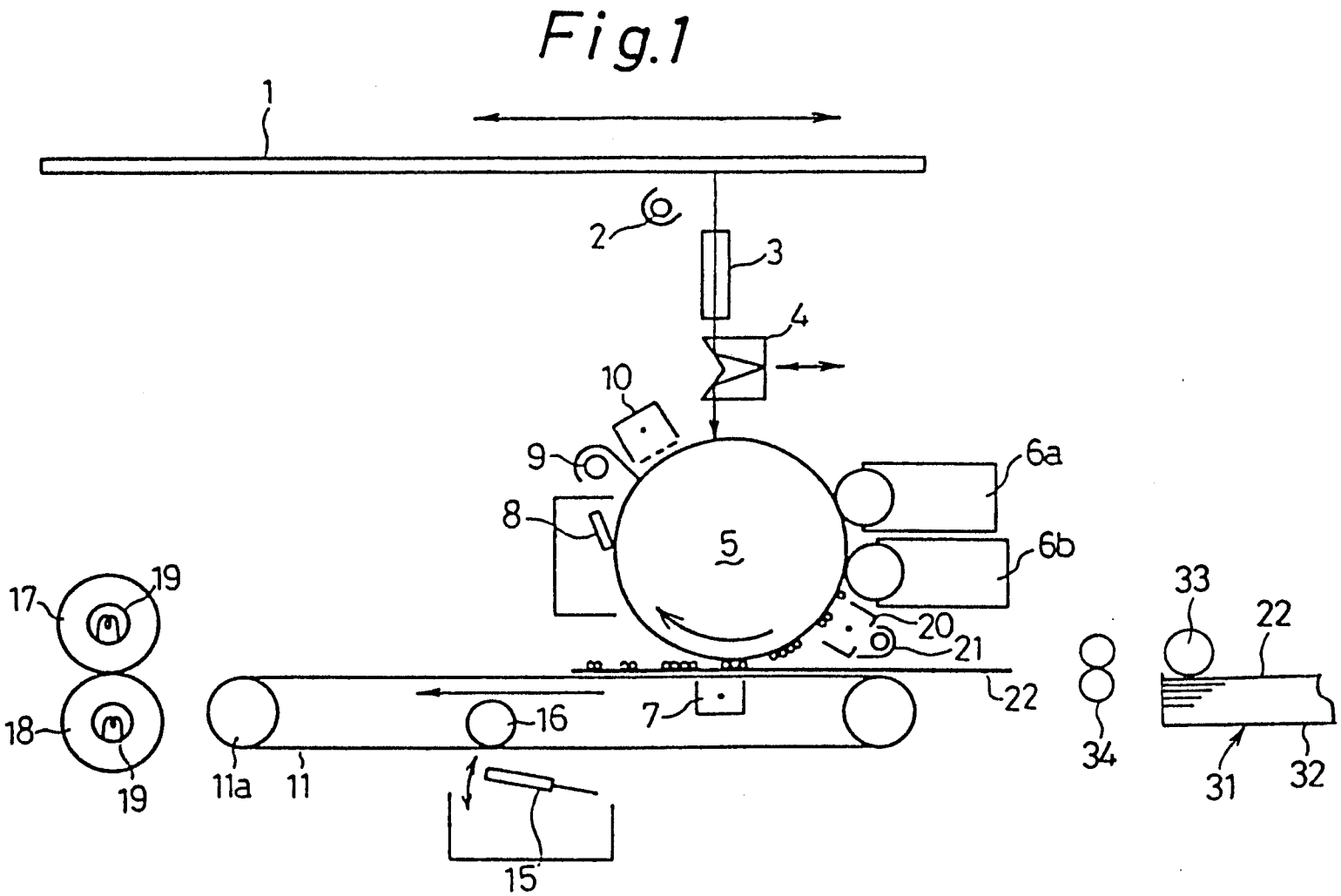
FIG. 1 is a schematic whole structural view showing an example of a copying machine to which the present invention is applied.
Figure 2:
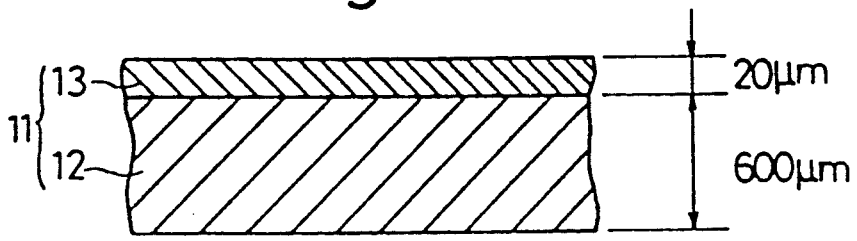
FIG. 2 is an enlarged cross sectional view showing a part of a transfer belt which is applied to the copying machine.

In the FIG. 1, reference numeral 1 designates an original glass table on which an original is placed, and it is movable in the direction of right and left in the figure. The numeral 2 designates a light source for illuminating the original, 3 an optical system such as a fiber lens array for projecting an image of the original onto a photoconductor 5. The numeral 4 designates a prism for converting an image projected on the photoconductor 5 into a regular image or reflected image. The prism is movable between the location where it enters into the projecting light path and the location where it gets out of the projecting light path. The photoconductor 5 is rotated in the direction shown by the arrow in the FIG. 1.

Around the photoconductor 5, developing units 6*a*, 6*b*, transfer charger 7, photoconductor cleaner 8, main eraser 9, charger 10 and the like are sequentially disposed starting from the exposure section of a projected image in the direction of rotation of the photoconductor 5.

An endless transfer belt 11 is stretched along a substantially horizontal sheet feed path which passes through the transfer section where the photoconductor 5 and the transfer charger 7 are positioned opposite to each other. The transfer belt 11 is composed, for example, of 600 μm thick urethane rubber basic material (electric resistance $10^9$-$10^{11}\Omega$cm)12 and a 20 μm thick polytetrafluoroethylene layer (electric resistance $10^{10}$-$10^{12}\Omega$cm)13 which is formed on the surface of the urethane rubber basic material as illustrated in the FIG. 2. The qualities of both of the materials have equivalent electric resistance characteristics to that of the transfer sheet, and they constitute a semiconductor type transfer belt.

Under the transfer belt 11, a belt cleaner 15 is provided, and a backup roller 16 is disposed across the transfer belt 11.

A sheet feed section 31 is provided upstream of the transfer belt 11 in the sheet transport path. The sheet feed section 31 is arranged to feed transfer sheets 22 accommodated in a sheet feed cassette 32 one by one to the sheet transport path by sheet feed roller 33. The transfer sheet 22 which was delivered receives a timing adjustment by timing roller 34, and is then fed to the transfer section for image transfer process.

At the side of sheet discharging end 11*a* of the transfer belt 11, there are disposed an upper fixing roller 17 and a lower fixing roller 18 across the sheet feed path. The numerals 19 designate heater lamps housed in the rollers 17, 18, and the heater lamps supply heat to the upper fixing roller 17 and the lower fixing roller 18 for fixing process.

Between the developing unit 6*b* and the transfer charger 7, there is disposed a reverse polarity corona charger 20, and an erase lamp 21 for irradiating the surface of the photoconductor 5 is further disposed at the back thereof.

Now, a description will be made of the operation.

First, the operation of copying both sides will be described below.

A first original is placed on the original glass table 1 under the state that the prism 4 is put on the light path as illustrated. Then, the original glass table 1 is moved from a right to a left side in the figure to form an electrostatic latent image of a regular image onto the photoconductor 5 which is charged at −500 V by the charger 10. The latent image on the photoconductor 5 is developed by a positively charged toner with the developing unit 6*a* or 6*b* which is provided with a developing bias of −150V. In the developing units 6*a* and 6*b*, the developer which includes the same polarity toner is accommodated.

A first toner image which is firstly formed on the photoconductor 5 is transferred onto a transfer belt 11 by the transfer charger 7 and makes one round of rotation without having been cleaned by belt cleaner 15. The belt cleaner 15 is brought in contact with the belt again for cleaning the surface of the transfer belt 11 after the first image has passed through.

Then, under the state that the prism 4 is put out of the light path, a second original is placed on the original glass table 1, and the table is moved from left to right in the figure to form an electrostatic latent image of a reflected image onto the photoconductor 5. The latent image on the photoconductor 5 is developed by the developing unit 6*a* or 6*b* to form a second toner image.

Polarity of toner layer of the second image is inverted before it reaches the transfer section by the corona charger 20 whose polarity is opposite to the polarity of the toner. At this stage, the electrostatic latent image on the photoconductor 5 is erased by the erase lamp 21 by receiving irradiation.

At the portion of electrostatic latent image on the photoconductor 5, the electric charge whose polarity is opposite to toner polarity is almost saturated. Therefore, when the polarity of toner layer is inverted by further applying reverse polarity charge, it is easy to charge the reverse polarity on the toner layer and the photoconductor by temporarily erasing the charge on the surface of the photoconductor 5. The electric charge by corona charge can thus be made larger by the erasing electrostatic charge of the photoconductor 5 by irradiation.

The first toner image which has made one round of rotation on the transfer belt 11 and the edge of the second toner image on the photoconductor 5 are arranged to simultaneously coincide with each other at the position where the photoconductor 5 contacts the transfer belt 11. Then, a transfer sheet 22 is fed by the timing roller 34 so as to have the edge of the toner image corresponds with the edge of the transfer sheet 22, and the second toner image on the photoconductor 5 is transferred onto the surface of the transfer sheet 22 by the transfer charger 7. The first toner image on the transfer belt 11 is simultaneously transferred onto the undersurface of the transfer sheet 22 by the transfer charger 7.

In the case when the first toner image is transferred on the transfer belt 11, opposite polarity voltage to the toner polarity of the first toner image is applied to the transfer charger 7. In the case when collective transfer is performed onto the transfer sheet 22, the same polarity voltage as that of the toner polarity of the first toner image, i.e. opposite polarity voltage to the inverted toner polarity of the second toner image, is applied.

When toner polarity is inverted as described above, it tends to lower the transfer efficiency compared with the case when the toner polarity is not inverted. It is, therefore, more advantageous to the transfer efficiency, and toner dispersion that toner polarity of the second toner image which is directly transferred onto the transfer sheet 22 from the photoconductor 5 is inverted than that toner polarity of the first toner image transferred from the photoconductor 5 to the transfer belt 11 and further transferred from the transfer belt 11 to the transfer sheet 22 is inverted.

The transfer sheet 22 on both sides of which toner images are transferred, and then discharged from the transfer belt 11 is fed to the location between the upper fixing roller 17 and the lower fixing roller 18 which are thermally controlled at nearly 185° C. for a simultaneous both sides fixing process.

When a single side copying operation is performed, an original is placed on the original glass table 1 under the state that the prism 4 is retracted from the light path, and the original glass table 1 is moved from a left to a right side in the figure to form an electrostatic latent image of a reflected image on the photoconductor 5. The latent image on the photoconductor 5 is developed by the developing units 6*a* or 6*b* to form a toner image.

The transfer sheet 22 is then fed so as to have the edge of the toner image correspond with the edge of the transfer sheet on the sheet feed path between the transfer belt 11 and the photoconductor 5. The toner image is transferred onto the transfer sheet 22 by the transfer charger 7, and then the sheet is forwarded toward the fixing rollers 17, 18 by the transfer belt 11 to complete one side copying operation after fixing the toner image.

The operation for performing composite copying will now be described.

Under the state that the prism 4 is put on the light path, a first original is placed on the original glass table 1, and the original glass table 1 is moved from a right to a left side in the figure to form an electrostatic latent image of a regular image onto the photoconductor 5. The latent image on the photoconductor 5 is developed by the developing unit 6*a*. The first toner image is transferred onto the transfer belt 11 by the charger 7 and makes one round of rotation without having been cleaned by the belt cleaner 15. The belt cleaner 15 is kept released from the state of pressed contact with the transfer belt even after the first toner image has passed through.

Then, a second original is placed on the original glass table 1, and a second toner image is formed by the developing unit 6*b* in the same manner as the first toner image. The second image is thereafter transferred onto the transfer belt 11 by the transfer charger 7. In this case, the first toner image which has traveled one round of rotation on the transfer belt 11 and the second toner image on the photoconductor 5 are arranged to simultaneously coincide with each other at the location where the photoconductor 5 comes in contact with the transfer belt 11.

In the case when toner polarity of the second toner image by the developing unit 6*b* differs from toner polarity of the first toner image by the developing unit 6*a*, it is required to provide uniform toner polarity by inverting the polarity with the reverse corona charger 20 and simultaneous irradiation by the erase lamp 21.

The transfer belt 11 is further rotated and the transfer sheet 22 is fed by the timing roller 34 so as to have the front edge of the transfer sheet 22 coincides with the front edge of the toner images. The belt cleaner 15 is pressed again to come in contact with the belt after the first and second images have passed through. Thereafter, the first and second toner images on the transfer belt 11 are composed by the transfer charger 7 and are transferred onto undersurface of the transfer sheet 22. Thus, the transfer sheet 22 with composite toner image transferred on its undersurface is discharged from the transfer belt 11 for fixing process by the lower fixing roller 18 to obtain a composite image. A colored composite image can be obtained by changing the colors of the first and second images.

Figure 3:
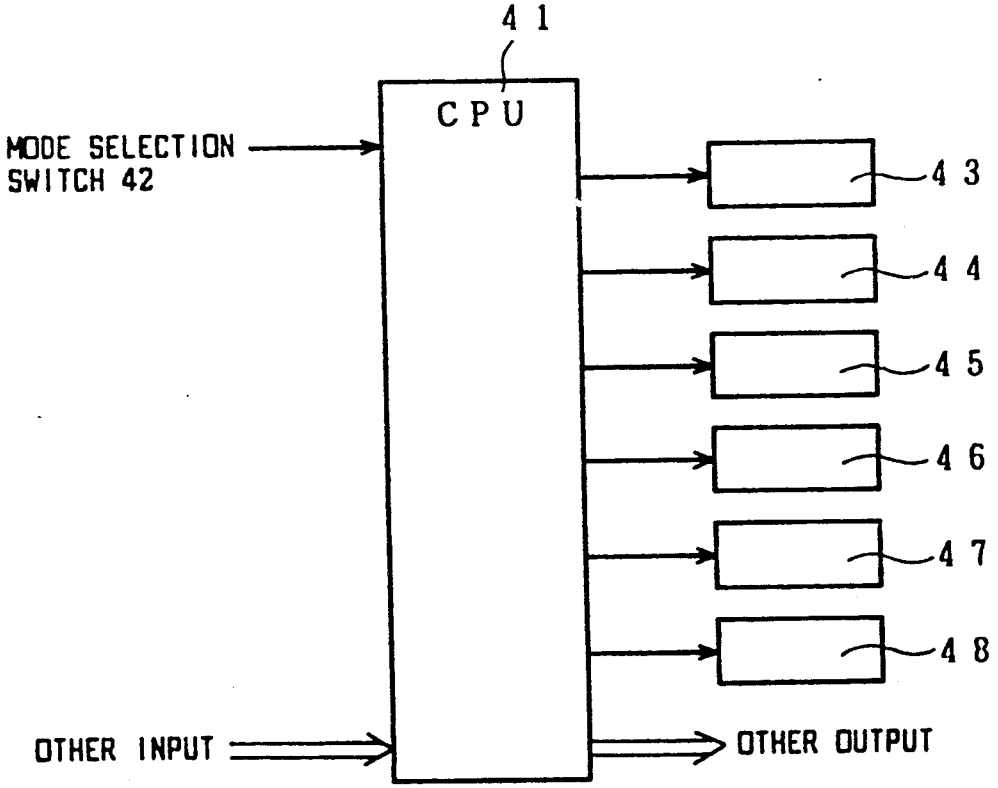
FIG. 3 is a main block diagram showing a control circuit of the copying machine.

In FIG. 3, there is briefly shown a control circuit for controlling each copying operation of the both sides copying, single side copying, composite copying and the like.

The control circuit is provided with a microcomputer. To the input section of the CPU 41, a selection switch 42 for selecting the copying mode and other input is connected. To the output section of the CPU 41, driver 43 of the transfer charger 7, driver 44 of the corona charger 20, driver 45 of the erase lamp 21, solenoid 46 of the prism 4, solenoid 47 of the belt cleaner 15, scanner motor 48 for moving the original glass table, and other output are connected respectively, and operation timing, polarity inversion and the like are controlled.

The mode selection switch 42 is provided on an unillustrated operation panel together with other operation keys and various indications, and said three copying modes are subsequently changed over every time the switch is pressed.

In the above-mentioned embodiment, an example has been shown wherein the reverse polarity corona charger 20 is utilized as a means to charge the first and second toner images with opposite polarities. However, oppositely charged polarity toners may be utilized for the developing unit 6*a* which forms a first toner image and the developing unit 6*b* which forms a second toner image. When these oppositely charged polarity toners are utilized, the system may be constructed in either a photoconductor which is capable of working on both negative and positive polarities or a laser exposure system and the like which is capable of exposing an image as a positive image or otherwise a negative image. In other words, when positive polarity toner is used for the photoconductor 5 which is charged with negative polarity as described in the above embodiment, an image is exposed as a positive image so that positive-positive image forming operation is performed. When negative polarity toner is used for the photoconductor 5 which is charged with negative polarity, an image is exposed as a negative image so that negative-positive image forming operation is performed.

When a transparent sheet such as a film or the like used for an overhead projector is utilized as a transfer sheet 22, both the first and second toner images are made as reflected images on the photoconductor 5 and are collectively transferred onto both sides of the transparent sheet to obtain a composite image. If colored toner is used for either one of the first or second toner image, a colored composite operation can be performed.

In the above-mentioned embodiment, a semiconductor type transfer belt 11 which is provided with the same electric resistance characteristic as that of a transfer sheet is utilized. However, a dielectric type transfer belt may also be used which is composed, for instance, of a 600 μm thick polystyrene basic material which contains carbon black as a conductive filler (electric resistance below $10^6$ Ωcm) and a 50 μm thick polybutylen layer as a dielectric layer (electric resistance over $10^{14}$ Ωcm) which is formed on the surface of the polystyrene basic material.

In the above embodiment, the present invention is applied to a copying machine as an example, however, it may be applied to a printer as well.

As it is clear from the description made above, according to the present invention, a fixing operation is performed after images are transferred onto both sides of a transfer sheet, and therefore, it is not necessary to turn over the transfer sheet when the sheet is fed. Moreover, images can be formed on both sides of the sheet rapidly without the necessity of enlarging the apparatus, and irregular sheet feed caused by heat curling can be avoided.

Further, according to the present invention, toner polarity is inverted by reverse corona charge on the photoconductor which possesses large capacitance or developing devices which are provided with different toner polarities are utilized so that the visual image on the photoconductor and the visual image on the intermediate transfer medium are oppositely charged on the photoconductor. A large electric charge can, therefore, be given to toner layer to achieve sufficient transfer efficiency by inverting the polarity on the intermediate medium whose capacitance is small. Without having fears of toner dispersion and poor quality of transfer, a clear image can be obtained to show the effect.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:

a latent image holding member;

means for forming first and second electrostatic latent images on the latent image holding member;

developing means for developing the first and second electrostatic latent images to first and second toner images of a predetermined polarity;

an endless toner image holding member provided opposite to the latent image holding member;

a first transfer means for transferring the first toner image onto the toner image holding member;

means for charging the second toner image on the latent image holding member with an opposite polarity to that of the previously transferred first toner image;

means for transporting a transfer sheet to the transfer location where the latent image holding member and the toner image holding member are positioned opposite to each other; and a second transfer means, provided at the transfer location, for simultaneously transferring the first toner image of a first polarity onto a transfer sheet from the toner image holding member and the second toner image of an opposite polarity onto the transfer sheet from the toner image holding member, respectively.

2. The image forming apparatus as defined in claim 1, wherein the second transfer means applies the same polarity electric charge as that of the first toner image from the back of the toner image holding member.

3. The image forming apparatus as defined in claim 1, wherein the first transfer means and the second transfer means are one charger for common use, and further comprising a means for changing over the polarity of the charger between the transfer of the first toner image and the second toner image.

4. The image forming apparatus as defined in claim 1, further comprising a means for erasing electric charge on the latent image holding member which is actuated together with the charger.

5. The image forming apparatus as defined in claim 1, wherein the second electrostatic latent image and the first electrostatic latent image are an inverted image from right to left and a non-inverted image respectively.

6. An image forming apparatus, comprising:

a photoconductor;

means for forming a latent image on the photoconductor;

developing means for developing the latent image to a toner image;

an endless toner image holding member provided opposite to the photoconductor;

means for inverting a polarity of the developed toner image on the photoconductor;

means for erasing an electric charge on the photoconductor;

means for transporting a transfer sheet to a location between the photoconductor and the toner image holding member;

transfer means provided at a back of the toner image holding member so as to confront the photoconductor through the toner image holding member at the location where the transfer sheet is transported to the toner image holding member, and having a first operation mode for transferring the toner image on the photoconductor onto the toner image holding member and a second operation mode for transferring the toner image on the toner image holding member onto a first surface of the transfer sheet simultaneously when a polarity inverted toner image on the photoconductor is transferred onto a second surface of the transfer sheet; and means for controlling the image forming operation wherein a first latent image is formed on the photoconductor by the latent image forming means and the image is developed to a first toner image, and then the first toner image is transferred onto the toner image holding member by the first operation mode, and thereafter, a second latent image is formed by the latent image forming means on the photoconductor where the first latent image has been erased by the erasing means and the image is developed to a second toner image, and then a polarity of the second toner image is inverted by the polarity inverting means, and further a transfer charger is actuated by the second operation mode to transfer the first toner image onto the first surface of the transfer sheet simultaneously when the second toner image is transferred onto the second surface of the transfer sheet being transported by the transporting means.

7. The image forming apparatus as defined in claim 6, wherein the second electrostatic latent image and the first electrostatic latent image are an image inverted from right to left and a non-inverted image respectively.

8. A method for forming images, comprising the steps of:

forming first and second electrostatic latent images on a latent image holding member;

developing the first and second electrostatic images to toner images;

transferring the first toner image onto an endless member;

inverting a polarity of the second toner image to an opposite polarity to that of a first toner image on the latent image holding member;

transporting a transfer sheet to a location between the endless member and the latent image holding member; and applying the same polarity transfer electric charge as that of the first toner image from a back of the endless member, thereby transferring the first and second toner images simultaneously onto each side of the transfer sheet, respectively.

9. A method of forming images, comprising the steps of:

forming a first toner image on an image holding member having a first polarity;

transferring the first toner image onto an endless member at a transfer location;

forming a second toner image on the image holding member whose polarity is opposite to that of the first toner image;

transporting a transfer sheet to the transfer position;

simultaneously transferring the first and second toner images onto each side of the transfer sheet by applying the same polarity transfer electric charge as that of the first toner image from the opposite side of the image holding means of the endless member at the transfer location.

* * * * *